US005236263A

United States Patent [19]

Friedland

[11] Patent Number: 5,236,263

[45] Date of Patent: Aug. 17, 1993

[54] PRINTING INK MIXING APPARATUS

[76] Inventor: Donald R. Friedland, 8300 Dupont Ave., No., Minneapolis, Minn. 55444

[21] Appl. No.: 957,878

[22] Filed: Oct. 8, 1992

[51] Int. Cl.[5] ..... B01F 9/12

[52] U.S. Cl. ..... 366/213; 366/221; 366/222; 366/224; 366/232

[58] Field of Search ..... 366/220, 221, 223, 224, 366/225, 232, 235, 236, 213, 208, 56, 222

[56] References Cited

U.S. PATENT DOCUMENTS 2,651,582 9/1953 Courtney ..... 106/167
3,809,322 5/1974 Hirosawa ..... 241/46.17
4,166,705 9/1979 Fronske ..... 366/221
4,403,867 9/1983 Duke ..... 366/142
4,720,194 1/1988 Fredland ..... 366/224
4,893,939 1/1990 Burk ..... 366/224

*Primary Examiner*—Robert W. Jenkins
*Attorney, Agent, or Firm*—Leo Gregory

[57] ABSTRACT

An apparatus to mix printing inks consisting of a mixing container having a single power source for rotating the container and the mixing blade therein with an automatic safety power shut off upon detachment of the mixing blade and a guard member about the rotating container.

6 Claims, 4 Drawing Sheets

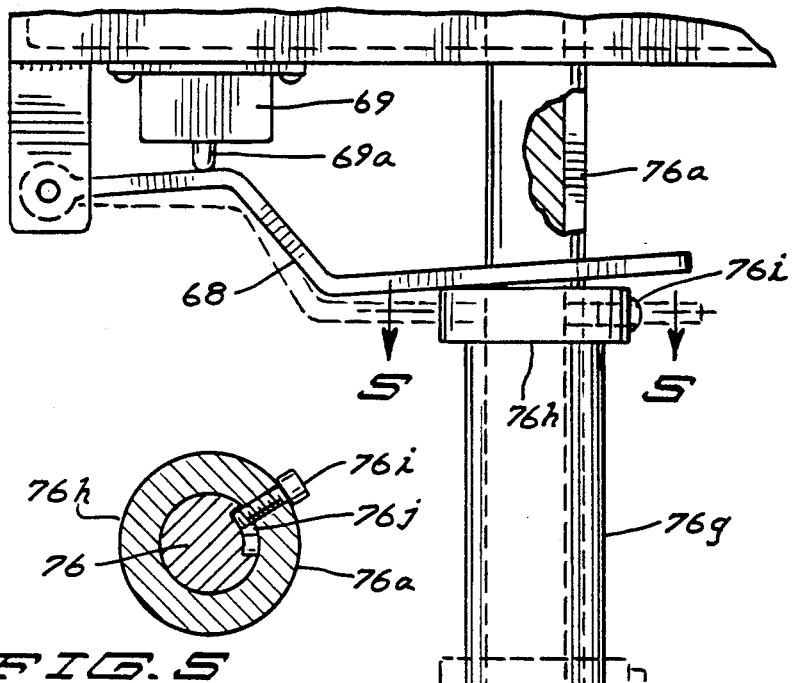
FIG. 5
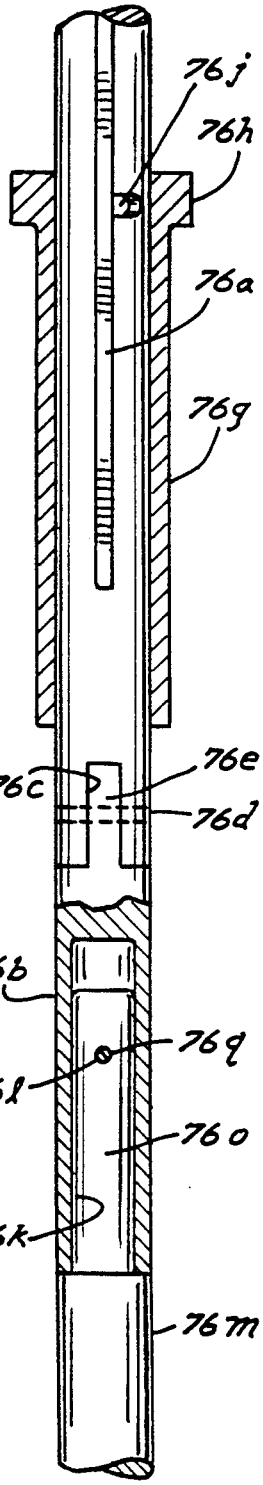
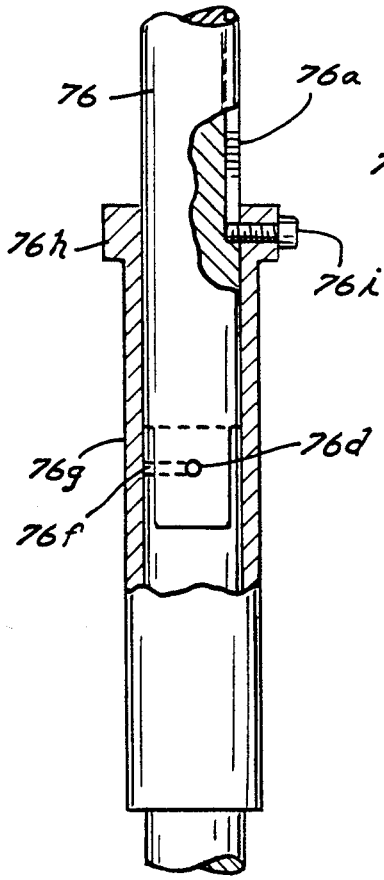
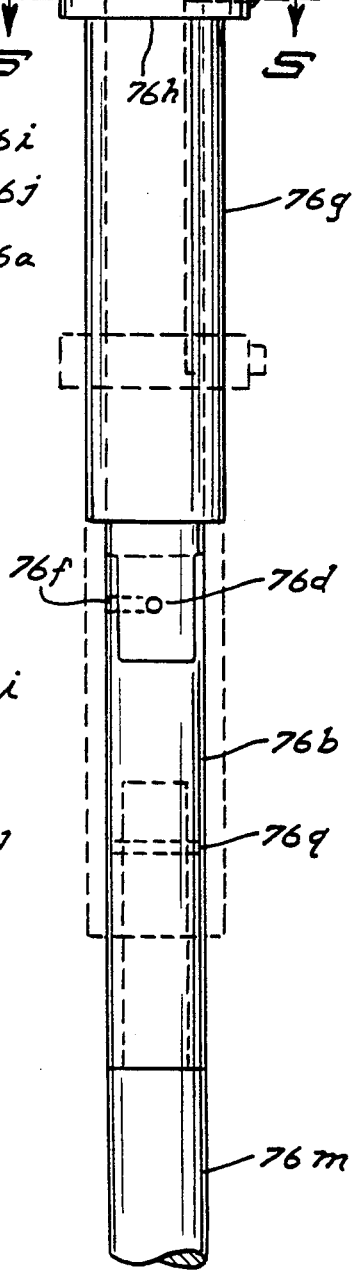
FIG. 7 FIG. 4 FIG. 6

PRINTING INK MIXING APPARATUS

BACKGROUND OF THE INVENTION

1. Field of Invention

This invention relates to a printing ink mixing apparatus.

2. Description Of The Prior Art

This invention relates to a printing ink mixing apparatus with particular emphasis on safety provisions and a common power source driving both the mixing container and the mixing blade.

Known of in the prior art is U.S. Pat. No. 4,403,867 to Duke wherein a separate power source is used to drive the container and the mixing blades therein.

Further it is not known that in the prior art there is present any safety operating feature such as a power shut off and prevention of an accidental power on situation upon removal of a mixing blade and protection to prevent engagement with a mixing container during the process of its rotation.

SUMMARY OF THE INVENTION

It is a particular object of the invention herein to provide an ink mixing apparatus which has a single power source and a single control of the power to operate both the rotation of the mixing container and the rotation of the mixing blade disposed therein.

More particularly it is an object of the invention herein to provide a safety feature wherein there is an automatic shut off of power when the mixing blade is detached with the shut off being arranged such that there can be no inadvertent turn on of the power.

It is also a particular object herein to provide guard members for the rotating mixing container to prevent any accidental engagement with the container while it is in operation.

These and other objects and advantages of the invention will be set forth in the following description made in connection with the accompanying drawings in which like reference characters refer to similar parts throughout the several views.

BRIEF DESCRIPTION OF THE DRAWINGS

FIG. 4 is a broken view in elevation showing portions thereof in dotted line and showing a portion broken away;

FIG. 5 is a view in cross section taken on line 5—5 of FIG. 4 as indicated;

FIG. 6 is a broken view in elevation with portions thereof in cross section and a portion in dotted line;

FIG. 7 is a broken view in elevation partially in cross section;

DESCRIPTION OF A PREFERRED EMBODIMENT

The structure disclosed and claimed herein represents significant improvement over the related structure of the applicant's prior U.S. Pat. No. 4,720,194 issued Jan. 19, 1988 with regard to the safety operating features disclosed and claimed herein.

Figure 2:
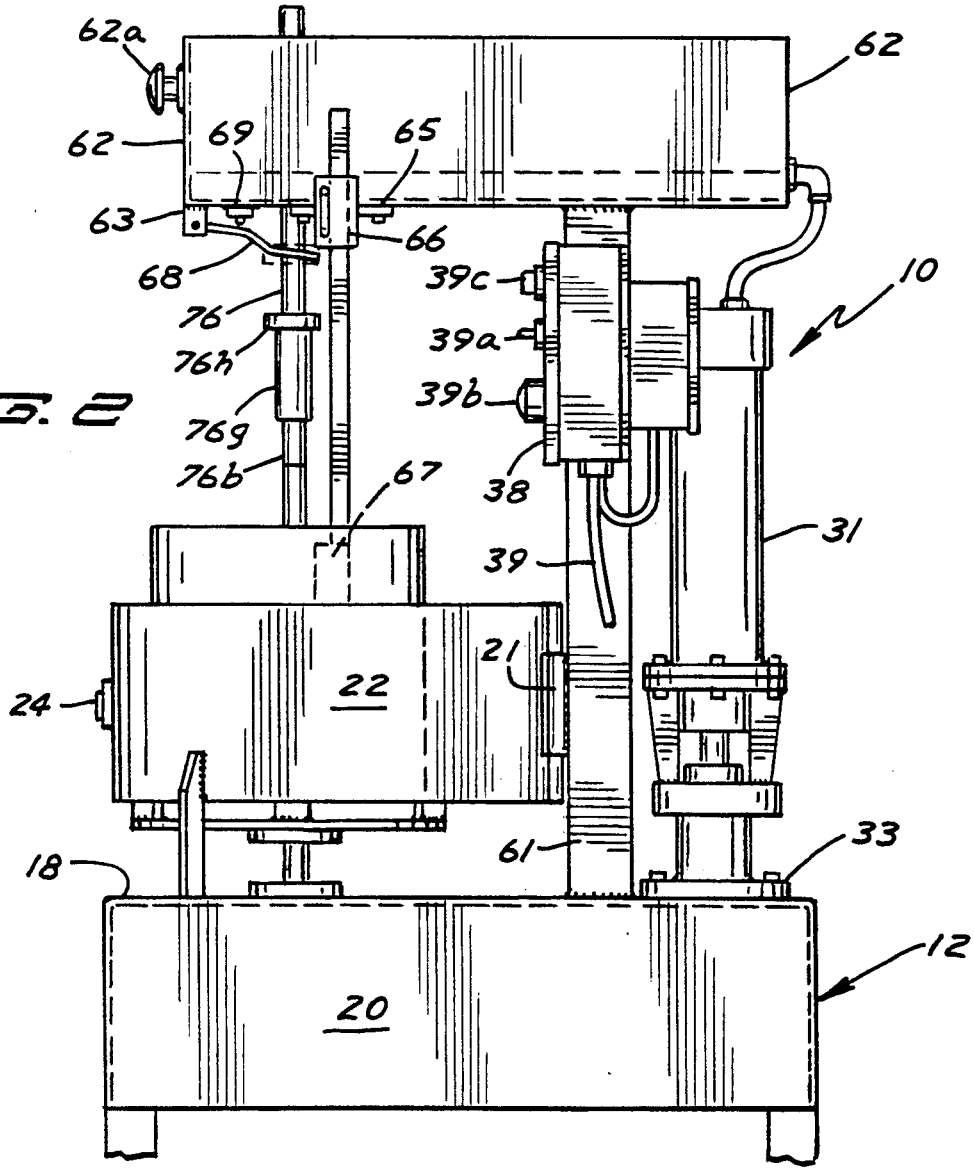
FIG. 2 is a side elevational view.

Referring to the drawings and particularly to FIG. 2, the apparatus comprising the invention herein is indicated generally by the reference numeral 10.

Supporting the apparatus in the embodiment shown is a base or table member 12 shown here to be rectangular in plan having a bottom plate or wall 14 and a top wall 18 forming a chamber 19 therebetween. Said base member has side walls about said chamber of which the front wall 20 is shown.

The apparatus herein comprises one mixing chamber or container 30.

Next will be described the gear arrangement supporting and driving or rotating said container.

Figure 3:
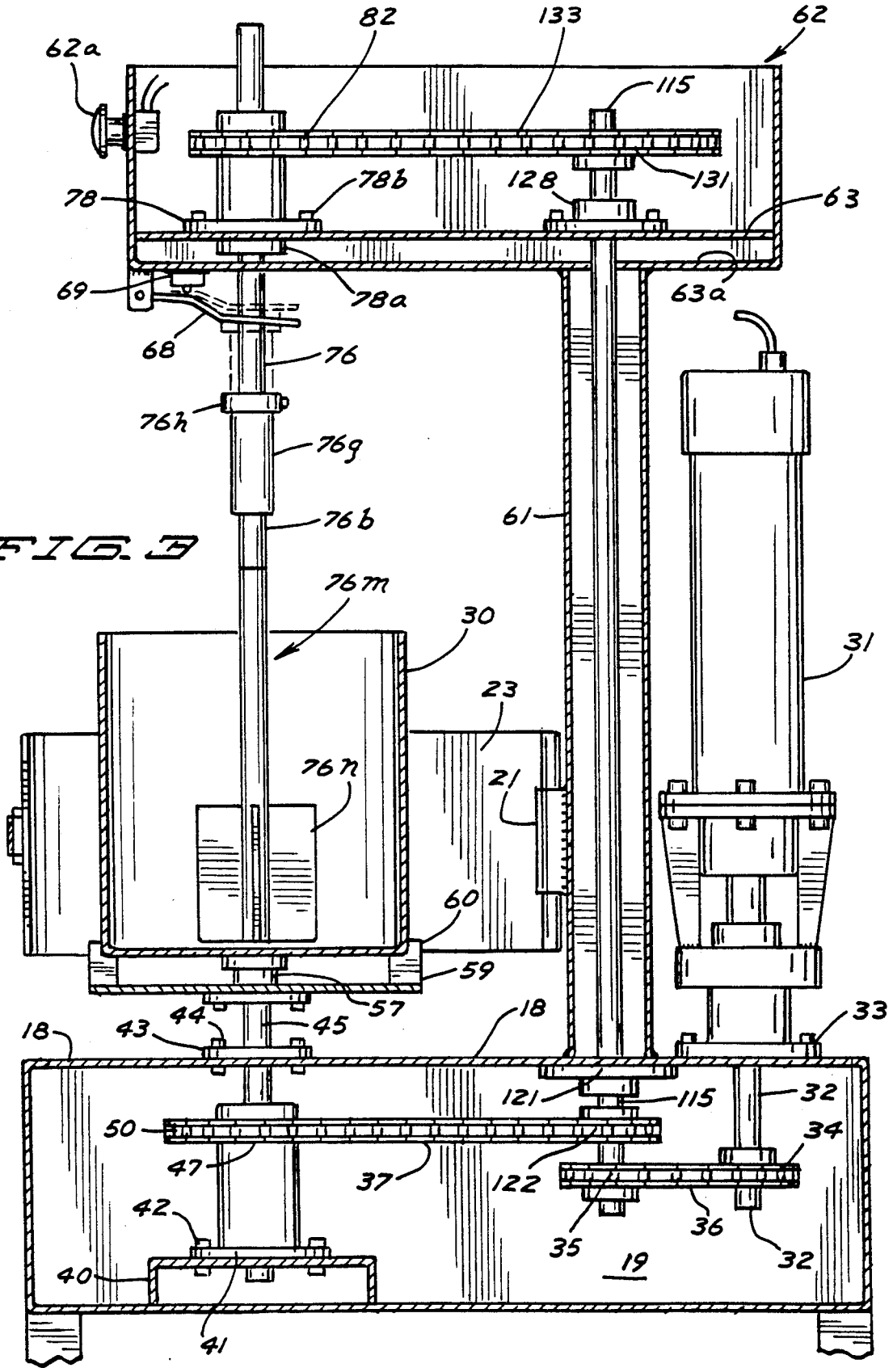
FIG. 3 is an elevational view in section taken on line 3—3 of FIG. 1 as indicated.

As shown in FIG. 3, mounted upon an elevated support member 40 as shown is a bearing plate 41 secured by bolts 42 and mounted onto said top chamber wall 18 is an aligned bearing plate 43 secured by bolts 44 and journaled therebetween is a shaft 45.

Journaled onto said shaft is a sprocket gear 47 having a sprocket 50.

The shaft 45 extends upwardly of said bearing plate 43 having secured thereto a hub shaped supporting base 57 upon which is mounted for driving engagement therewith a circular plate member or turntable 59 having spaced thereabout upstanding projections or fingers 60 to retain upon said plate for rotation therewith said mixing container 30 which is here indicated as being a pail type cylindrical container. Said container has a non-slipping fit in being seated upon said plate member.

It has been experienced that a better mixed product and a more efficient mixing operation is achieved by using medium sized containers such as five gallon capacity containers.

Upstanding from adjacent one end of said base member 12 as shown is an upstanding post or column member 61 which is rectangular in horizontal section and which extends to a working height above said mixing container. Said post supports a horizontally projected substantially rectangular housing 62 which is suspended over said mixing container having vertically spaced bottom walls 63 and **63*a*** and is in effect a gear housing chamber.

Underlying said post 61 and said wall 18 being mounted onto the underside of said wall is a bearing plate 121 having a shaft 115 journaled therethrough and extending vertically through said wall 18 and having a lower extension thereof having a sprocket gear 122 secured thereto. Passing over said sprocket gear 122 and over said sprocket gear 50 is a sprocket chain 37.

A bearing plate member 128 is mounted onto the inner or upper side of said bottom wall 63 through which is journaled the upward extension of said shaft 115. A sprocket gear 131 is attached to adjacent the upper end portion of said shaft 115.

Spaced forwardly within said chamber 62 and secured to the bottom wall 63 thereof is a bearing plate assembly 78 being substantially a duplicate of the aligned underlying bearing plate member 43.

Said bearing plate assembly 78 includes downwardly extending hub **78*a***.

Extending into the mixing container 30 and extending upwardly through the bearing plate assembly 78 is a driving shaft 76. Journaled onto the upper portion of said shaft is a sprocket gear 82. Passing over the sprocket gear 131 and the sprocket 82 is a sprocket chain 133.

Now with particular reference to the shaft 76, said shaft extends only partially into the mixing container 30. Said shaft has a vertical groove 76*a* in the face thereof for something more than the upper half of the length thereof. The lower portion of said shaft is segmented having a removable extension 76*b* thereof (FIGS. 4–7).

At the lower end of the shaft 76 is a vertical slot 76*c* having transversely therethrough a pin 76*d* extending across said slot. The extension 76*b* has an upper end portion 76*e* of reduced width to fit into said slot and extending partially across said reduced width end portion is a transverse slot 76*f* to receive said pin 76*d* for a releasable locking engagement. Adapted to fit over said shaft and slide thereon is a sleeve 76*g* having a collar 76*h* about its upper end disposed through said collar is a flat end screw 76*i* which projects into said groove 76*a*. In operation, said sleeve will slide downwardly to the lower end of said slot 76*a* at which point said screw 76*i* becomes a stop member and said sleeve extends over the joining of said shaft 76 and its extension, locking the extension in place. At approximately the midway point of said slot 76*c* is a transverse detent 76*j*,whereby when said collar 76*h* is raised to this point and twisted, said screw 76*i* will engage said detent and hold said sleeve in this partially raised inoperative position to permit said extension to be removed. Further in this position said collar engages a safety switch to be described which shuts off the power to the entire apparatus.

The extension 76*b* has an upwardly extending bore 76*k* and through said shaft adjacent the top of said bore, an aperture 76*l* extends through the shaft.

To be mounted onto the lower end of said shaft 76*b* is a mixer or beater 76*m* of an appropriate configuration shown having a cross blade 76*n* extending to the bottom of said container 30, the blade having a handle portion 76*o* which slips into said bore 76*k*. Said handle has an aperture 76*p* corresponding to and adapted to be aligned with said aperture 761 and disposed therethrough is a pin 76*q* which with the sleeve 76*g* thereover locks the mixing blade in operating position.

Secured to the outer side of said bottom wall 63*a* is an arm bracket 65 extending to overlie the rim of said container 30. At the end of said bracket is a hub 66 and disposed therein and extending therebelow is a conventional wiper blade 67 of the type commonly used for ink mixing containers and the blade is so positioned as to bear against the inner side of said container to prevent any accumulation thereon.

Upstanding from said wall 18 adjacent to said post 61 is a cylindrical housing 31. Disposed in said housing and not shown is a conventional gear reducer driven by an attached DC motor 31*a* indicated in FIG. 9. Said reducer and motor are illustrated and more fully described in applicant's prior patent above identified. Extending downwardly from said gear reducer in said housing 31 is a shaft 32 extending through a bearing plate member 33 mounted upon the outer or upper side of the wall 18 and having attached thereto is a sprocket gear 34. On said shaft 115 horizontally spaced from sprocket gear 34 is a sprocket gear 35. A sprocket chain 36 passes over the sprocket gears 34 and 35 to drive the shaft 115 and beater shaft 76 as will be described and a sprocket chain 37 passes over the sprocket gears 122 and 50 to drive the turntable 59 and rotate the mixing container 30. The sprockets are designed to have the mixing blades and mixing container rotate at relative speeds such as at a ratio of ten to one RPMS.

Suitably mounted onto said post 61 is a power switch box 38 which embodies a panel board 38*a* and which by means of lines 39 will be connected to a suitable power source 38*b*. Said box is equipped with the conventional off and on buttons 39*a* and 39*b* and a speed control knob 39*c*. The wiring is conventional as indicated in the wiring diagram of FIG. 9.

Figures 8, 9:
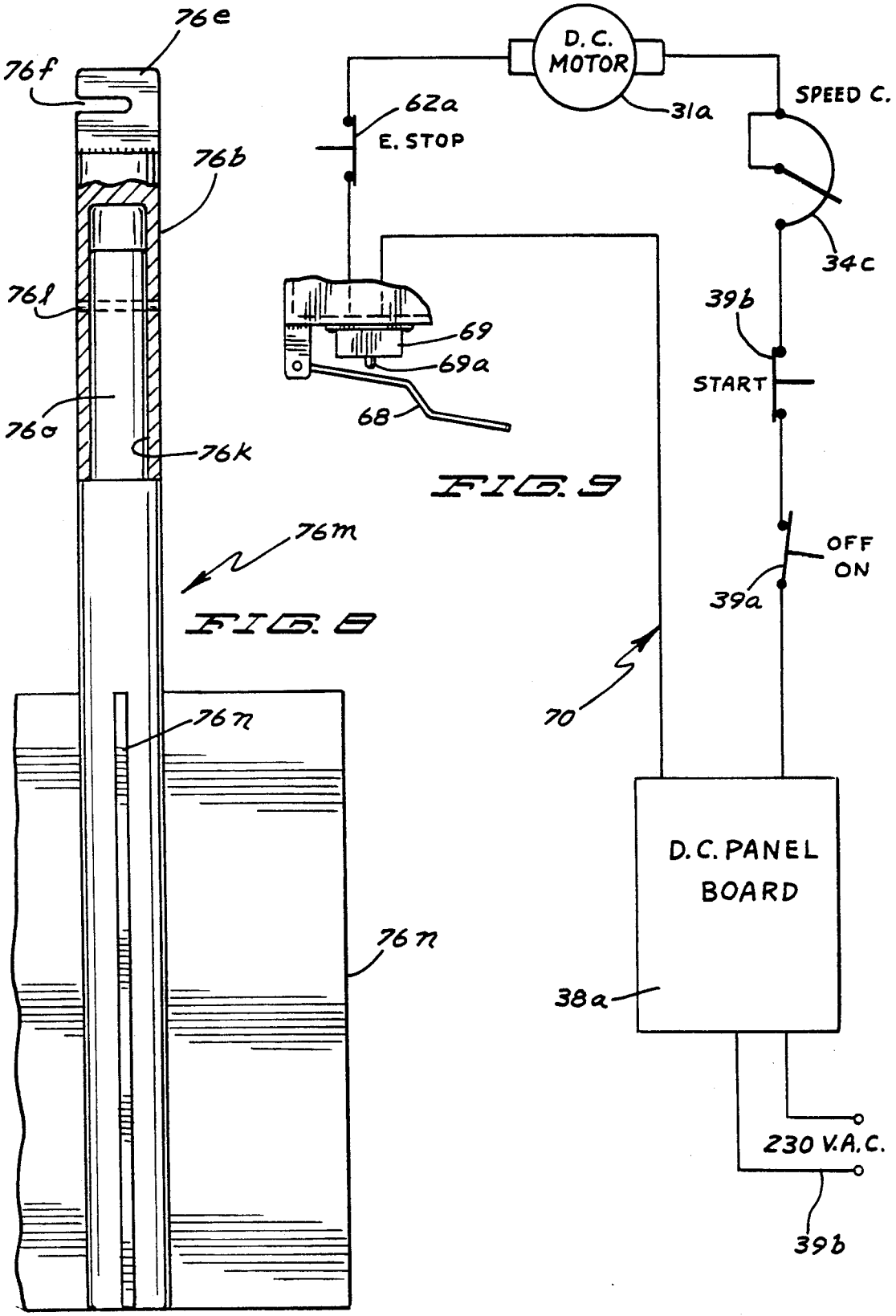
FIG. 8 is a view in elevation of a mixing blade with the upper portion thereof in cross section.
FIG. 9 is a broken view of a switch member and a control circuit in connection therewith.

Mounted on the bottom wall 63*a* of the chamber 62 adjacent the upper end of the shaft 76 is an electric switch lever 68 which has a slotted end projecting over said shaft and which is engaged by the collar 76*h* when the sleeve 76*g* is in raised position. The switch lever engages the switch button 69*a* of the switch 69 which is conventionally wired as indicated in FIG. 9 to shut off the power as for the removal and replacement of the beater blade to provide a positive prevention of any accidental operation at a time when the machine is not intended to be in operation. This is a very significant safety precaution and is illustrated in FIG. 9.

Again with reference to the post 61, secured thereto is a wide hinge 21 having carried thereby a pair of semicircular enclosure gate or guard members 22 and 23 which are pivoted to encompass the outer side of the mixing container 30 and carry a latch member 24. This guards against any contact by an operator with said mixing container when the same is rotating in its mixing operation.

Figure 1:
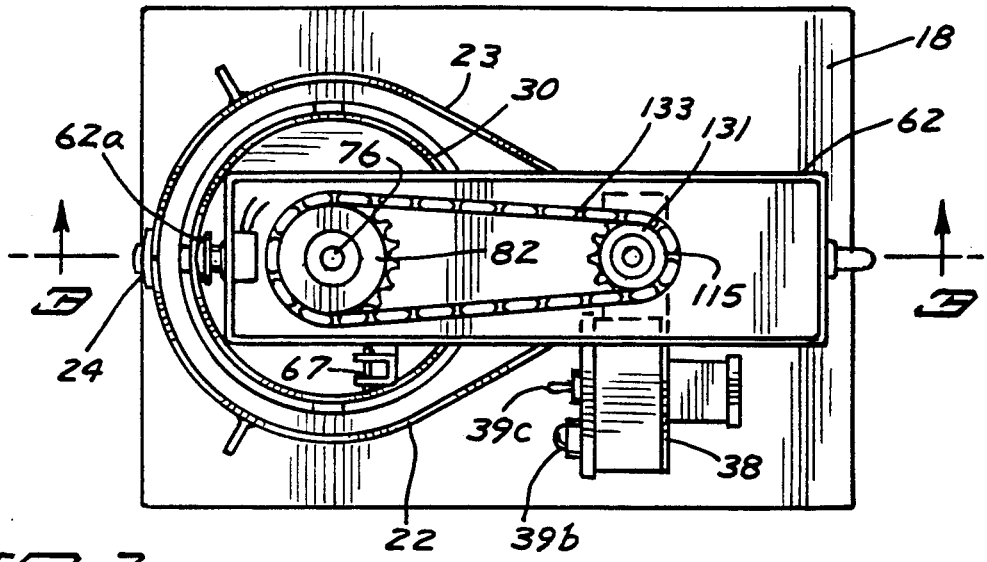
FIG. 1 is a top plan view.

Extending outwardly of an end wall of the housing 62 as shown in FIG. 1, is an emergency switch 62*a* which is also shown in the wiring diagram of FIG. 9. Said switch is conventional and requires no further explanation.

OPERATION

Mixing printing inks is a time honored art.

The improvement relative to the industry which is present in the apparatus herein is represented by a single power source to drive both the mixing container and the mixing blade.

Improvement is present in the shaft 76 which is a splined shaft as described and permits a very simple procedure to change the mixing blades. When the sleeve 76*g* is raised and twisted at the detent 76*j*, it is held there in inoperative position and the collar 76*h* thereon engages said switch button 69*a* and urges it to off position whereby power to the entire machine cut off and the mixing container 30 is incapable of rotation. This is a very important safety feature. The splined joint in the mixing shaft is disengaged and the mixer blade is readily removed for exchange. It is noted that the handle 76*o* of the beater blade has an aperture 76*p* and when the beater blade is installed with its handle being disposed into the bore 76*h* of the shaft extension 76*b*, a pin 76*q* is disposed into the aligned bores to retain the mixing blade.

In the operation of the ink mixing, the relative speeds of the mixing blade and the rotation of the mixing container are set as required by adjustment of the control knob 39*c* on the control panel 38*a*. The blades are driven at a faster rate than the mixing container, and as indicated a good working ratio is on the order of 10 RPMS to one.

It will of course be understood that various changes may be made in the form, details, arrangement and proportions of the apparatus without departing from the scope of the invention which generally stated, consists in an apparatus capable of carrying out the objects above set forth, such as disclosed and defined in the appended claims.

What is claimed is:

1. A printing ink mixing apparatus, having in combination a base housing, supporting means mounted onto said base housing, a plate member carried by said supporting means, driving means in connection with said supporting means rotating said plate member, a mixing container carried by said plate member, a post like member upstanding from said base member, an elevated housing member supported by said post like member and extending across said base member, a shaft supporting means carried by said elevated housing, a shaft depending from said shaft supporting means into said mixing container, a mixing blade adapted to be removably secured to said shaft, a sleeve slidable on said shaft, said sleeve in lowered, operating position locking said blade onto said shaft, a switch member carried by said elevated housing adjacent said shaft, said switch member being in a circuit controlling the power supply to the apparatus, means holding said sleeve in a raised inoperative position, and said sleeve in raised position engaging said switch to cut off said power supply to the apparatus.

2. A printing ink mixing apparatus, having in combination a supporting base, a post like member upstanding from said base adjacent one end thereof, an elevated cross member carried by said upstanding member and extending across said base member, a mixing container, means carried by said base rotatably supporting said mixing container therein, a bearing plate carried by said elevated cross member, a shaft journaled into said bearing plate extending into said mixing container, said shaft having a lower disconnectable section, a mixing blade, said section being adapted to have said mixing blade releasably connected thereto, a sleeve slidably carried on said shaft, and said sleeve extending over and being adapted to operatively secure the connection of said lower section of said shaft and said shaft.

3. The structure of claim 2, wherein said shaft has an axial surface groove in the upper portion thereof, a transverse slot extending from an upper portion of said groove partially about said shaft, said sleeve having an inward projection riding in said groove, said sleeve in raised position by a twist motion having said projection enter said slot and hold said sleeve in said raised position, a switch carried by said elevated member adjacent said shaft, said switch member being in a circuit controlling the passage of current from a power source to said apparatus, and said sleeve in said raised position engaging said switch to open said circuit.

4. The structure of claim 2, wherein said lower disconnectable shaft portion having an axial bore extending partially thereinto upwardly thereof from the lower end thereof, said mixing blade having a handle portion extending into said bore, said shaft and said handle having an aligned aperture, a pin extending through said apertures, and said sleeve in lowered position overlying said apertures and pin, thus securing said mixing blade in an operating position.

5. The structure of claim 2, wherein said mixing container is adjacent said upstanding post, a hinge member carried by said upstanding member, a pair of semi-circular arms carried by said hinge, said arms having a width substantially the height of said mixing container, said arms being adapted to embrace said container spaced somewhat therefrom thereabout, and a latch member securing said arms about said container.

6. The structure of claim 2, wherein a bracket is secured to said elevated cross member, and an elongated wiping blade extends from said bracket into said mixing container engaging the full height of an inner wall portion thereof.

* * * * *